US006593851B1

(12) United States Patent
Bornstein

(10) Patent No.: US 6,593,851 B1
(45) Date of Patent: Jul. 15, 2003

(54) TWO-WAY PARENT-CHILD PAGING SYSTEM

(76) Inventor: Aimee Bornstein, 27 Beacon Hill, Sugar Land, TX (US) 77479

( * ) Notice: Subject to any disclaimer, the term of this patent is extended or adjusted under 35 U.S.C. 154(b) by 0 days.

(21) Appl. No.: 09/717,582

(22) Filed: Nov. 21, 2000

(51) Int. Cl.[7] ..... G08B 1/08

(52) U.S. Cl. ..... 340/539.15; 340/568.1; 340/573.4

(58) Field of Search ..... 340/325, 539, 340/568.1, 568.6, 571, 573.1, 573.4, 738, 7.53, 7.57, 539.1, 539.11, 539.15, 531

(56) References Cited

U.S. PATENT DOCUMENTS

| | | | | | |
|---|---|---|---|---|---|
| 4,157,540 | A | | 6/1979 | Oros | 340/539 |
| 4,598,272 | A | | 7/1986 | Cox | 340/539 |
| 4,873,520 | A | | 10/1989 | Fisch et al. | 340/7.57 |
| 5,196,825 | A | | 3/1993 | Young | 340/539 |
| 5,289,163 | A | | 2/1994 | Perez et al. | 340/539 |
| 5,337,041 | A | | 8/1994 | Friedman | 340/573.4 |
| 5,485,163 | A | * | 1/1996 | Singer et al. | 342/457 |
| 5,604,492 | A | | 2/1997 | Abdul-Halim | 340/7.53 |
| 5,640,147 | A | | 6/1997 | Chek et al. | 340/573.4 |
| 5,652,569 | A | | 7/1997 | Gerstenberger et al. | 340/573.4 |
| 5,768,696 | A | | 6/1998 | Law | 455/127 |
| 5,825,283 | A | * | 10/1998 | Camhi | 340/438 |
| 5,923,255 | A | | 7/1999 | Vahdatshoar | 340/573.4 |
| 5,950,632 | A | | 9/1999 | Reber et al. | 128/898 |
| 5,952,918 | A | | 9/1999 | Ohayon | 340/539 |
| 6,025,779 | A | | 2/2000 | Huang | 340/539 |
| 6,043,747 | A | | 3/2000 | Altenhofen | 340/573.1 |
| 6,091,329 | A | * | 7/2000 | Newman | 340/539 |
| 6,239,700 | B1 | * | 5/2001 | Hoffman et al. | 340/539 |
| 6,243,039 | B1 | * | 6/2001 | Elliot | 342/457 |
| 6,265,974 | B1 | * | 7/2001 | D'Angelo et al. | 340/568.1 |

* cited by examiner

*Primary Examiner*—Van Trieu
(74) *Attorney, Agent, or Firm*—Bracewell & Patterson, LLP

(57) ABSTRACT

A two-way, parent-child communication system includes a parent unit and at least one child unit. The parent and child units are capable of both sending and receiving signals to and from the corresponding unit to cause any number of alerts or messages to be communicated to the parent, child and/or guardian. Each unit may include a number of different alert mechanisms, including an audible alert, a visual alert, a vibratory alert or voice messages.

20 Claims, 2 Drawing Sheets

TWO-WAY PARENT-CHILD PAGING SYSTEM

BACKGROUND OF INVENTION

1. Field of the Invention

The present invention relates to a system for providing two-way communication between a parent and child wherein a first unit is worn or carried by a parent or guardian and a second unit is worn or carried by a child.

2. Description of the Prior Art

There are many devices which allow a parent to locate a child by attaching the device to the child and causing the device to emit an audible or visual alert when the child becomes lost. For instance, U.S. Pat. No. 5,625,569 (Gerstenbeger) describes a child alarm device consisting of a parent or guardian transmitter unit and a child receiver unit. The receiver is attached to the child and when the parent desires to locate the child, the parent causes the transmitter to transmit a signal to the receiver, which, in turn, activates an audible alarm. The audible alarm may also be activated directly from the child receiving unit. It is not possible, however, for the child unit to transmit a signal to the parent unit, as would be useful where the parent is in a location where the audible alarm could not be heard.

A two-way baby monitor system is described in U.S. Pat. No. 6,043,747 (Altenhofen), wherein a parent unit can record messages which may then be transmitted to the baby unit to soothe or calm the baby. The baby unit includes a microphone and can transmit sounds to the parent unit. However, in order for the parent to detect a problem with the child, the parent must constantly monitor the sounds being transmitted from the baby unit. This is not always convenient, especially when in a public venue.

The personal safety system described in U.S. Pat. No. 5,337,041 (Friedman) includes a hand-held, guardian control means and a portable alarm means designed to be carried by a child or pet. The control means may transmit a signal to the alarm means thereby causing the alarm means to emit an audio or visual alarm signal. The alarm signal may be used by the guardian to locate the child or pet, or may be used to signal those near alarm means that the wearer needs assistance. The alarm means may also transmit a confirmation signal to the control means to alert the guardian that the alarm means has been activated. The system does not, however, allow the child or another in the vicinity of the child, to alert the guardian that the child is lost or needs assistance.

It would therefore be desirable to provide a two-way system for communication between parent and child wherein the system would allow either the parent or the child (or guardian) to establish communication with the other.

It would further be desirable to provide a two-way system of communication between a parent and child wherein both the parent and child units maintain in constant contact with each other.

SUMMARY OF THE INVENTION

The present invention is a two-way paging system which may be used, for instance, to provide a communication link between a parent and child. The system includes at least two paging units, a first, parent unit to be carried and monitored by a parent or guardian and at least one additional second, child unit which is to be carried, worn or otherwise affixed to a child. The parent unit and child unit are each capable of transmitting and receiving signals to and from the corresponding unit. Where more than one child unit is in use, the parent unit would be able to receive signals from and transmit signals to a plurality of such child units.

The parent unit typically includes at least a housing, a transmitter assembly, receiver assembly, an alert mechanism and a battery. The transmitter assembly may transmit a signal to the corresponding child unit(s) over any suitable distance using a predetermined frequency. The receiver assembly may be capable of receiving a signal sent by one or more of the child units. In each case, the signal sent by the transmitter assembly or received by the receiver assembly should correspond to the signal sent or received by the corresponding child unit(s). The alert mechanism, which typically includes an audible alert, visual alert, vibratory alert or a combination thereof, is activated by the receiver assembly upon receipt of a signal from a child unit. Where a combination of alerts are available, the parent may typically choose which method of alert is suitable for a given location. For instance, in a noisy environment, the visual and/or vibratory alerts may be most appropriate. If the parent is carrying the unit in a handbag or backpack, the audio alert may be more suitable. The battery may be either a rechargeable or replaceable.

The parent unit may also include an alert button or switch which allows the parent to activate the transmitter assembly, thereby transmitting a signal to the child unit(s). Typically, the button or switch may be depressed for a relatively short duration to send a first signal and may be depressed for a relatively longer duration to send a second signal. The first signal may correspond, for instance, to a more routine alert or message when received by the child unit, whereas the second signal may correspond to an emergency alert or message.

Any number of additional features may be incorporated into the parent unit, including a voice messaging subsystem which would broadcast a pre-recorded voice message upon receipt of a specific signal from a child unit. An out-of-range indicator may also be included to alert the parent that the child unit may no longer send or receive signals from the child unit. Typically, both systems will periodically send identification data to one another at predetermined intervals. In this way, both systems may determine that the corresponding system or systems are on and operating properly and are within signal range.

The child unit includes the transmitter system, the receiver system, the alert mechanism and the battery, as described above for the parent unit. Both the transmitter system and the receiver system are capable of sending signals to and receiving signals from the parent unit, thereby allowing two-way communication between the units. Any number of child units may correspond to a single parent unit.

The child unit includes a button or switch for activating the transmitter system and transmitting a signal to the parent unit. This button may be activated by either the child to alert the parent that the child may need assistance or the button may be activated by a temporary guardian, should either the guardian or the child need the assistance of the parent. As with the parent unit, the button may be depressed for a relatively short duration to cause a first type of alert or may be depressed for a relatively longer duration to cause a second type of alert.

Typically, both systems will periodically send identification data to one another at predetermined intervals. In this way, each system can verify that the corresponding system is on and operating properly and is within signal range.

DETAILED DESCRIPTION OF THE PREFERRED EMBODIMENT

Figure 1:
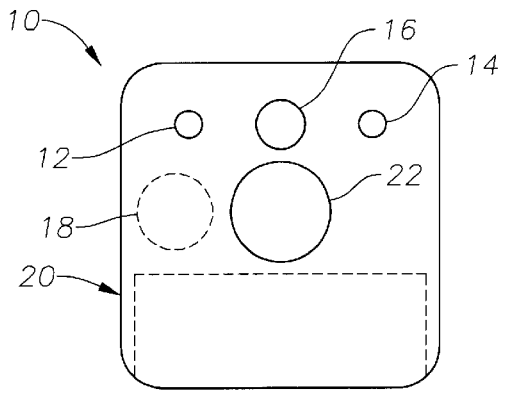
FIG. 1 shows a front view of child unit.

The parent and child units of the present invention are shown in FIGS. 1–4. FIG. 1 shows a front view of the child unit 10. In order to increase ease of operation for the user, a number of indicators may be located on the front of the unit 10. For instance, an LED power light or indicator 12 may be located on the front of the unit 10 and would indicate whether the unit is turned on and whether there is sufficient battery strength to power the unit. The LED power indicator is preferably able to indicate whether the unit is on and operating properly, such as by displaying a green color and may also indicate a low power condition, such as by displaying a red color. The unit 10 may also include an LED status light or indicator 14. The LED status indicator 14 may be used to alert the user to a number of conditions. For instance, the status indicator 14 may display a green color to indicate that the unit has not received an alert signal from a parent unit, it may display an orange color to show that the corresponding parent unit is out of signal range or is not operating and it may display a red color to indicate that an alert signal has been received from a parent unit. A power switch or button 16 may be located on the front of the unit 10. Preferably, the power button 16 is countersunk to prevent accidental actuation. Additionally, the power button typically must be depressed for a certain, predetermined period of time, for instance, one second, before the unit will either turn on or off.

A sound transducer 18 is preferably located on the front of the unit 10 to allow improved sound quality when the unit is worn or carried. The transducer may be of any suitable construction. Preferably, the transducer may produce at least two distinct tones. More preferably, the transducer may produce any number of tones and may further reproduce pre-recorded voice messages. In one embodiment, the transducer is located directly behind a perforated grill or section of the front panel 20 of the unit 10.

An alert switch or pushbutton 22 is located on the front panel 22 of the unit 10. The alert button 22 is in electrical connection with the transmitter system (shown in FIGS. 5 and 6) of the unit. When the alert button is depressed for a relatively short duration, the transmitter transmits a first, normal signal. The normal signal typically indicates that the child needs assistance, but that there is no emergency condition. If the alert button 22 is depressed for a relatively longer duration, the transmitter will transmit a second emergency signal which indicates that an emergency condition exists and the child needs immediate assistance. Preferably, the alert button 22 is designed to prevent accidental activation, such as by countersinking the button or by providing toggle activation.

Figure 2:
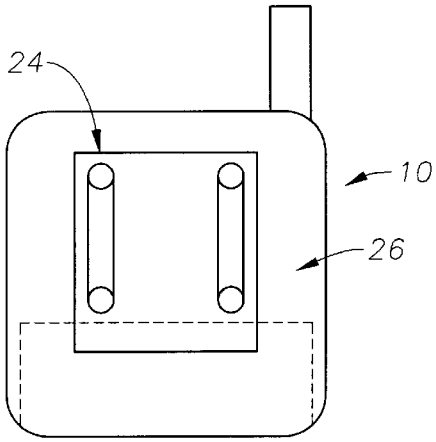
FIG. 2 shows a rear view of the child unit.

FIG. 2 shows a rear view of the child unit 10. A mounting patch or bracket 24 is affixed to the rear panel 26 of the unit 10 to allow an attachment device 28 to be mounted thereon. The attachment device 28 preferably includes two cased-style safety pins for securing the unit to the clothing of a child. It should be understood, however, that any suitable attachment device may be used.

An information plate (not shown) may also be affixed to the rear of the unit 10. The information plate would preferably contain such information as emergency contacts for the child or instructions for the finder of a lost child. Additionally, a preferred embodiment of the present invention may include a tracking mechanism (not shown) that would allow parents or authorities to track and locate the child in the event the child is lost or abducted. Such a mechanism may include, for instance, a satellite tracking device, such as those used on automobiles.

Figure 3:
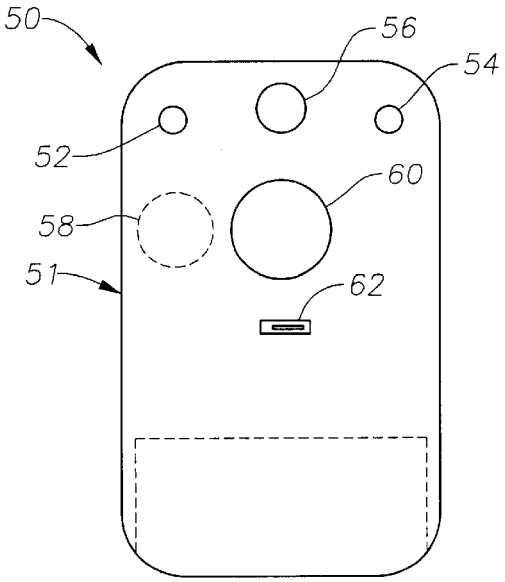
FIG. 3 shows a front view of the parent unit.
Figure 4:
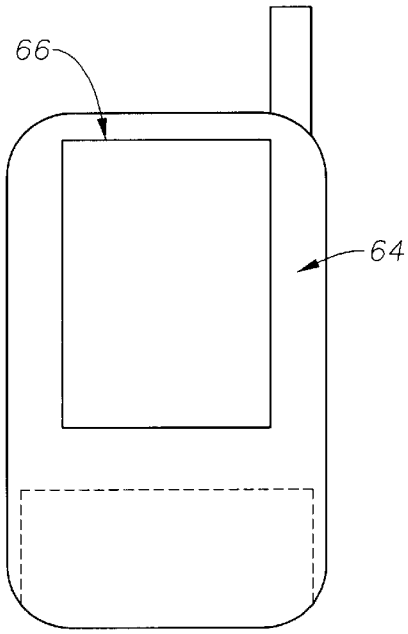
FIG. 4 shows a rear view of the parent unit.

FIGS. 3 and 4 show the parent unit 50 of the present system. The front panel 51 contains a number of similar buttons and indicators as previously described for the child unit 10. An LED power indicator 52 indicates the power status of the unit, including power on, power off and low battery. An LED status indicator 54 preferably indicates the alert status of the unit, including whether a normal alert, emergency alert or no alert has been received from a corresponding child unit. A power switch or button 56 is preferably countersunk to prevent accidental actuation, as similarly described for the child unit. The sound transducer 58 is preferably capable of producing at least two alert tones and more preferably is capable of producing any number of tones, as well as reproducing pre-recorded voice messages.

Figure 5:
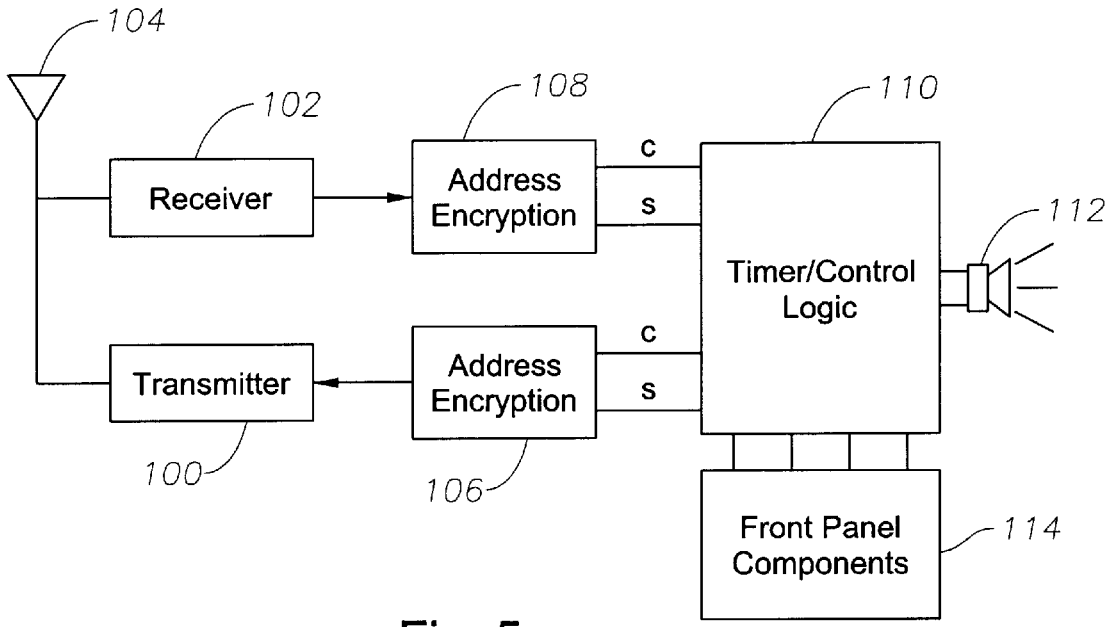
FIG. 5 shows a schematic of a non-microcontroller based architecture.
Figure 6:
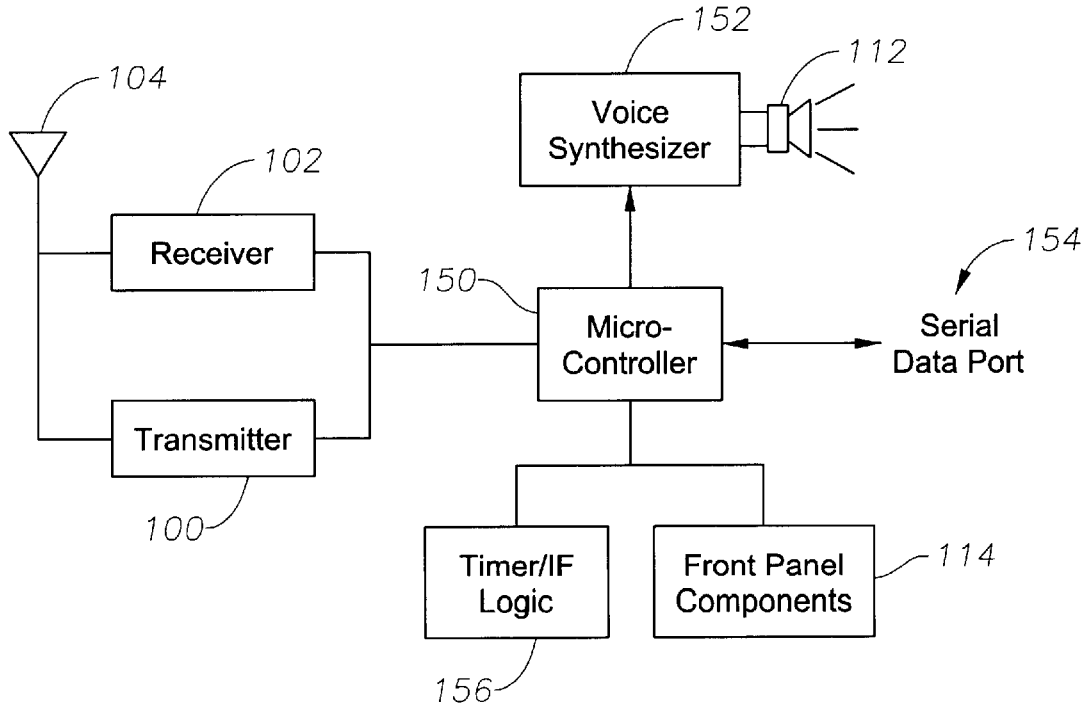
FIG. 6 shows a schematic of a microcontroller based architecture.

The alert switch or button 60 of the parent unit 50 is in electrical contact with the transmitter assembly (as shown in FIGS. 5 and 6). The alert switch 60 may be operated or actuated in at least two ways. First, the alert switch may be depressed for a relatively short duration, thereby causing a first, non-emergency signal to be sent by the transmitter assembly to the child unit. Second, the alert switch may be depressed for a relatively longer duration to cause the transmitter assembly to transmit an emergency or "child locator" signal to the child unit.

Additionally, the parent unit 50 includes a mute toggle switch 62 which is moveable between first and second positions. In the first position, the unit will produce audible alert tone upon receipt of an alert signal from a child unit. When the mute toggle switch is in the second position, the unit 50 will not produce an audible alert tone, but may still produce visual and vibratory alerts so that the user is notified upon receipt by the unit of an alert signal. By allowing the user to toggle off the audible alert, the unit may be used in locations where the audible alert would be considered a distraction, such as, for instance, in a religious facility or in a theater.

On the back panel 64 of the parent unit 50, a fastening device 66 may be affixed. Preferably, the fastening device is a belt clip or shirt clip, but may be any suitable device to allow the user to easily carry the unit. An information plate or strip (not shown) may be attached to the back panel of the parent unit. Such a plate may include information regarding temporary caregiver contact information, emergency contact information and instructions for the finder of a lost child.

FIG. 5 shows a schematic of a non-microcontroller based architecture representing the internal assemblies of both the parent and child units. A transmitter assembly 100 is capable of sending signals from one unit to a corresponding unit through antenna 104. The transmitter assembly may produce signals at any suitable frequency, but preferably produces signals in the 900 MHz range. Similarly, a receiver assembly 102 is capable of receiving signals through antenna 104 from corresponding units in any suitable frequency range, but preferably receives signals in the 900 MHz range. The antenna 104 may be fully contained within the housing (not shown) of the unit or may be partially positioned externally, such as in the case of cellular telephones and the like. In order to prevent errant signals from interfering with the operation of the units, an address encryption mechanism 106 may be employed to provide a secure method of transmission between the units. The encryption mechanism also allows each unit to periodically send identification information to corresponding units, thereby establishing and maintaining contact between the units. Thus, for instance, if a parent unit sends an identification signal to a corresponding child unit and a suitable return signal is not received within a predetermined period of time, the parent unit may produce an alert to notify the user that the child unit is either out of signal range or otherwise inoperable. Once a signal is received by the receiver assembly 102, it may pass through a decryption mechanism 108 which decrypts the signal before passing it to the control and logic assembly 110.

The control and logic assembly 110 controls the functions of the unit and interacts either directly or indirectly with all of the assemblies and switches contained in the unit. For instance, the transducer 112, is in direct electrical contact with the control assembly 110 such that when an alert signal is passed to the control assembly 110 from the receiver assembly 102, the control assembly 10 activates the transducer 112 to produce an appropriate tone. However, in the case of the parent unit, the position of the mute toggle switch will determine whether the transducer is activated. The front panel controls 114, including the power button, alert button and LED's, are all in direct electrical contact with the control assembly 110. The control assembly accepts input from the various buttons or switches of the unit and directs an appropriate response thereto. For instance, a signal received by the control assembly indicating a short depression of the alert button would preferably cause the control assembly to send a signal to the transmitter to transmit a normal alert signal.

In a second embodiment, and as shown in FIG. 6, a microcontroller based architecture may be employed with the present invention. Any suitable microcontroller assembly may be used. The addition of the microcontroller 150 allows the addition of many features. For instance, a data port 154 may be included which would allow communication between the unit and a personal computer ("PC") or other device. The port may include any suitable PC interface, such as a parallel data port, universal bus port, or infrared ("IR") port, but is preferably a serial data port. This may allow the unit to be programmed with information such as the unit address, the addresses of corresponding units and country of origin speech phrasing set. In addition, a data port could allow the unit to be tested prior to use and may allow the upload of executable firmware.

A voice synthesizer or voice synthesizing module 152 may also be included in the present invention. The module 152, when programmed with a speech phrasing set (which would preferably reside within non-volatile memory in the module), allows the unit to reproduce certain phrases which would be beneficial in alerting either the parent, child or temporary caregiver. The module may be in electrical connection with the microcontroller 150 and the transducer 112. Alternatively, the module 152 may be in electrical contact with only the microcontroller 150. Any suitable voice synthesizer module may be employed. In a preferred embodiment, a single voice synthesizer chip may be used, such as that manufactured by ISD.

In order to assure that the parent and child units are successfully able to communicate with one another, each unit preferably includes a channel or address selection mechanism. This mechanism may include, for instance, a physical switch which is accessible to the user, who can set each parent and corresponding child unit to the same channel or address or may include a software switch which is accessed through a data port which similarly allows channel or address selection. Regardless of the specific type of switch used, in order to ensure that each parent unit is able to communicate with each child unit, all units must have corresponding channels or addresses.

Each unit includes a battery, which may be of any type suitable to power the unit. For instance, the battery may be of the removable, non-rechargeable type, such as a single 9 volt battery or a single or multiple AA or AAA batteries. Alternatively, the battery may be a suitable rechargeable type.

While certain embodiments and features of the current invention have been described in detail herein, it will be understood that the invention encompasses all enhancements and modifications within the scope and spirit of the claims that follow.

I claim:

1. A two-way paging system to locate either a parent or a child, the system comprising:

a parental paging unit including a first portable housing adapted to readily connect to clothing of a parent, a first transmission assembly positioned within the first housing to provide at least one of a first signal and a first emergency signal, a first receiver assembly positioned within the first housing to receive at least one of the following a second signal and a second emergency signal, a first transducer assembly positioned within the first housing to produce an audible alert upon receipt of at least one of the second signal and the second emergency signal by the first receiver assembly, a first alert mechanism associated with the first housing and in electrical contact with the first transmission assembly to cause the first transmission assembly to transmit at least one of the first signal and the first emergency signal, a first power source associated with the first housing to provide power at least to the first transmission assembly, the first receiver assembly, and the first transducer assembly, and a first alert switch responsive to the parent, connected to the first housing, and in electrical contact with the first transmission assembly to cause the first transmission assembly to transmit the first signal when the first alert switch is activated by a user for a first preselected time period to thereby indicate a first emergency condition whereby the parent needs assistance and a first emergency signal when the first alert switch is activated by the user for a second preselected time period to thereby indicate a second emergency condition whereby the parent needs immediate assistance, the second preselected time period being longer than the first preselected time period; and a child paging unit including a second portable housing adapted to readily connect to clothing of a child, a second transmission assembly positioned with the second housing to provide the at least one of a second signal and a second emergency signal to the first receiver assembly of the parental paging unit, a second receiver assembly positioned within the second housing to receive at least one of the first signal and the first emergency signal from the first transmission assembly of the parental paging unit, a second transducer assembly positioned within the second housing to produce an audible alert upon receipt of the first signal by the second receiver assembly, a second alert mechanism associated with the second housing and in electrical contact with the second transmission assembly to cause the assembly to transmit at least one of the second signal and the second emergency signal, a second power source associated with the second housing to provide power at least to the second transmission assembly, the second receiver assembly, and the second transducer assembly, and a second alert switch responsive to the child, connected to the second housing, and in electrical contact with the second transmission assembly to cause the second transmission assembly to transmit the second signal when the second alert switch is activated by a user for a first preselected time period to thereby indicate a first child emergency condition whereby the child needs assistance and the second emergency signal when the second alert switch is activated by the user for a second preselected time period to thereby indicate a second child emergency condition whereby the child needs immediate assistance, the second preselected time period being longer than the first preselected time period.

2. A system as defined in claim 1, wherein the parent paging unit further includes a first voice synthesis module positioned within the first housing and in electrical contact with the first transducer assembly, the first voice synthesis module including a memory and a set of speech phrasing stored in the memory to thereby allow the parent paging unit to reproduce the set of speech phrasing so that the parent is alerted by the set of speech phrasing of a predetermined condition for the child.

3. A system as defined in claim 1, wherein the child paging unit further includes a second voice synthesis module positioned within the second housing and in electrical contact with the second transducer assembly, the second voice synthesis module including a memory and a set of speech phrasing stored in the memory to thereby allow the parent paging unit to reproduce the set of speech phrasing so that the child is alerted by the set of speech phrasing of a predetermined condition for the parent.

4. A system as defined in claim 1, wherein the parent paging unit further includes a first microcontroller assembly positioned within the first housing and in electrical connection with the first transmission assembly, the first receiver assembly, and the first transducer assembly, and wherein the first power source comprises a rechargeable battery.

5. A system as defined in claim 4, further including a plurality of first visible indicators connected to the first housing and in electrical contact with the first microcontroller assembly to indicate a plurality of parental conditions, each of the plurality of parental conditions having a distinct first visible indicator, the plurality of parental conditions being selected from at least one of the following: that the parental paging unit is on and operating properly, that the first power source is low, that the parental paging unit has not received at least one of the second signal and the second emergency signal, that the child paging unit is not operating, and that the parental paging unit has received at least one of the second signal and the second emergency signal.

6. A system as defined in claim 5, further including a first channel selection mechanism and a first encryption mechanism, the first channel selection mechanism allows the user to set the parental paging unit to a same channel as the child paging unit, the first encryption mechanism ensures that the parental paging unit and child paging unit are in continuous communication, if continuous communication is lost one of the plurality of first visible indicators will indicate that the child paging unit is not operating.

7. A system as defined in claim 4, wherein the first microcontroller assembly includes a first data port connected to the first housing and in electrical contact with the first microcontroller assembly to allow a first input from a personal computer to be sent to the parental paging unit, the first input being selected from at least one of a parental paging unit channel and a child paging unit channel, the first data port allowing the parental paging unit to be tested prior to use and allowing executable firmware to be uploaded to the parental paging unit.

8. A system as defined in claim 1, wherein the child paging unit further includes a second microcontroller assembly positioned within the second housing and in electrical connection with the second transmitter assembly, the second receiver assembly, and the second transducer assembly, and wherein the second power source comprises a rechargeable battery.

9. A system as defined in claim 8, further including a plurality of second visible indicators connected to the second housing and in electrical contact with the second microcontroller assembly to indicate a plurality of child conditions, each of the plurality of child conditions having a distinct second visible indicator, the plurality of child conditions being selected from at least one of the following: that the child paging unit is on and operating properly, that the second power source is low, that the child paging unit has not received at least one of the first signal and the first emergency signal, that the parental paging unit is not operating, and that the child paging unit has received at least one of the first signal and the first emergency signal.

10. A system as defined in claim 9, further including a second channel selection mechanism and a second encryption mechanism, the second channel selection mechanism allows the user to set the child paging unit to a same channel as the parental paging unit, the second encryption mechanism ensures that the parental paging unit and child paging unit are in continuous communication, if continuous communication is lost one of the plurality of the second visible indicators will indicate that the parental paging unit is not operating.

11. A system as defined in claim 1, wherein the parental paging unit includes a mute toggle switch positioned within the first housing and in electrical connection with the first receiver assembly, the mute toggle switch being adapted to be moved between a first position and a second position, the first position producing an audible alert tone upon receipt of at least one of the second signal and the second emergency signal, and the second position producing visual and vibratory alerts upon receipt of at least one of the second signal and the second emergency signal.

12. A system as defined in claim 1, wherein the second housing of the child paging unit has a plate member having indicia thereon including information about the child selected from at least one of the following: child emergency contact information, instructions for a locator of the child, and combinations thereof.

13. A system as defined in claim 1, further including an attachment device connected to the second housing of the child paging unit, the attachment device comprising at least a pair of spaced apart child inhibiting connectors adapted to connect to various areas of a child's clothing and to inhibit the child from readily disconnecting the child paging unit.

14. A system as defined in claim 1, further including a first power button positioned on the first housing and a second power button positioned on the second housing, and wherein the first alert switch and the first power button are countersunk from the first housing and the second alert switch and the second power button are countersunk from the second housing.

15. A system as defined in claim 1, wherein the first transducer assembly is capable of producing at least two parent distinct tones, with a first parent distinct tone corresponding to receipt of the second signal and a second parent distinct tone corresponding to receipt of the second emergency signal and the second transducer assembly is capable of producing at least two child distinct tones, with a first child distinct tone corresponding to receipt of the first signal and a second child distinct tone corresponding to receipt of the first emergency signal.

16. A two-way paging system to locate either a-parent or a child, the system comprising:

a parental paging unit including a first portable housing adapted to readily connect to clothing of a parent, a first transmission assembly positioned within the first housing to provide at least one of a first signal and a first emergency signal, a first microcontroller assembly positioned within the first housing and in electrical connection with the first transmission assembly, a first receiver assembly positioned within the first housing to receive at least one of the following a second signal and a second emergency signal, a first transducer assembly positioned within the first housing to produce an audible alert upon receipt of at least one of the second signal and the second emergency signal by the first receiver assembly, a first alert mechanism associated with the first housing and in electrical contact with the first transmission assembly to cause the first transmission assembly to transmit at least one of the first signal and the first emergency signal, a first power source associated with the first housing to provide power at least to the first transmission assembly, the first receiver assembly, and the first transducer assembly, and a first alert switch responsive to the parent, connected to the first housing, and in electrical contact with the first transmission assembly to cause the first transmission assembly to transmit the first signal when the first alert switch is activated by a user for a first preselected time period to thereby indicate a first emergency condition whereby the parent needs assistance and a first emergency signal when the first alert switch is activated by the user for a second preselected time period to thereby indicate a second emergency condition whereby the parent needs immediate assistance, the second preselected time period being longer than the first preselected time period, a plurality of first visible indicators connected to the first housing and in electrical contact with the first microcontroller to indicate that the parental paging unit has not received at least one of the second signal and the second emergency signal, that the child paging unit is not operating, and that the parental paging unit has received at least one of the second signal and the second emergency signal; and a child paging unit including a second portable housing adapted to readily connect to clothing of a child, a second transmission assembly positioned with the second housing to provide the at least one of a second signal and a second emergency signal to the first receiver assembly of the parental paging unit, a second microcontroller assembly positioned within the second housing and in electrical connection with the second transmission assembly, a second receiver assembly positioned within the second housing to receive at least one of the first signal and the first emergency signal from the first transmission assembly of the parental paging unit, a second transducer assembly positioned within the second housing to produce an audible alert upon receipt of the first signal by the second receiver assembly, a second alert mechanism associated with the second housing and in electrical contact with the second transmission assembly to cause the assembly to transmit at least one of the second signal and the second emergency signal, a second power source associated with the second housing to provide power at least to the second transmission assembly, the second receiver assembly, and the second transducer assembly, and a second alert switch responsive to the child, connected to the second housing, and in electrical contact with the second transmission assembly to cause the second transmission assembly to transmit the second signal when the second alert switch is activated by a user for a first preselected time period to thereby indicate a first child emergency condition whereby the child needs assistance and the second emergency signal when the second alert switch is activated by the user for a second preselected time period to thereby indicate a second child emergency condition whereby the child needs immediate assistance, the second preselected time period being longer than the first preselected time period, a plurality of second visible indicators connected to the second housing and in electrical contact with the second microcontroller to indicate that the child paging unit has not received at least one of the first signal and the first emergency signal, that the parental paging unit is not operating, and that the child paging unit has received at least one of the first signal and the first emergency signal.

17. A system as defined in claim 16, wherein the parent paging unit further includes a first voice synthesis module positioned within the first housing and in electrical contact with the first transducer assembly, the first voice synthesis module including a memory and a set of speech phrasing stored in the memory to thereby allow the parent paging unit to reproduce the set of speech phrasing so that the parent is alerted by the set of speech phrasing of a predetermined condition for the child and wherein the child paging unit further includes a second voice synthesis module positioned within the second housing and in electrical contact with the second transducer assembly, the second voice synthesis module including a memory and a set of speech phrasing stored in the memory to thereby allow the parent paging unit to reproduce the set of speech phrasing so that the child is alerted by the set of speech phrasing of a predetermined condition for the parent.

18. A method of locating either a caregiver or a child, the method comprising the steps of:

activating an alert switch associated with at least one of a pair of pager units by a user for at least a first preselected time period to thereby indicate a first emergency condition whereby at least one of a caregiver associated with one of the pair of pager units and a child associated with the other one of the pair of pager units needs assistance; and activating the same alert switch by a user for at least a second preselected time period to thereby indicate a second emergency condition whereby at least one of a caregiver and a child needs immediate assistance, the at least a second preselected time period being longer than the at least a first preselected time period.

19. A method as defined in claim 18, further including visually indicating a plurality of status conditions on one of the pair of pager units, the status conditions being selected from at least one of the following: activation of the alert switch associated with the other one of the pair of pager units indicating a first emergency condition, activation of the alert switch associated with the other one of the pair of pager units indicating a second emergency condition, non-activation of the alert switch associated with the other one of the pair of pager units, confirmation that the one of the pair of pager units is on and operating properly, confirmation that a power source associated with the one of the pair of pager units is low, and confirmation that the child paging unit is not operating.

20. A method as defined in claim 18, further including audibly indicating receipt of a signal corresponding to activation of the alert switch by activating a voice synthesizing module to reproduce a set of speech phrasing stored in a memory of the voice synthesizing module so that at least one of a caregiver associated with one of the pair of pager units and a child associated with the other one of the pair of pager units is alerted by the set of speech phrasing of a predetermined condition.

* * * * *